US010161624B2

(12) United States Patent
Hall

(10) Patent No.: US 10,161,624 B2
(45) Date of Patent: Dec. 25, 2018

(54) STEAM DILUENT GENERATOR

(71) Applicant: ConocoPhillips Surmont Partnership, Calgary (CA)

(72) Inventor: Jeffrey A. Hall, Calgary (CA)

(73) Assignee: ConocoPhillips Surmont Partnership, Calgary (CA)

( * ) Notice: Subject to any disclaimer, the term of this patent is extended or adjusted under 35 U.S.C. 154(b) by 397 days.

(21) Appl. No.: 14/940,730

(22) Filed: Nov. 13, 2015

(65) Prior Publication Data

US 2016/0138796 A1 May 19, 2016

Related U.S. Application Data

(60) Provisional application No. 62/079,281, filed on Nov. 13, 2014.

(51) Int. Cl.

| | |
|---|---|
| ***E21B 43/40*** | (2006.01) |
| ***E21B 43/24*** | (2006.01) |
| ***F22B 31/00*** | (2006.01) |
| ***C10G 21/00*** | (2006.01) |
| ***F22B 1/18*** | (2006.01) |
| ***F22B 9/00*** | (2006.01) |
| ***C10G 75/04*** | (2006.01) |
| ***F23C 10/12*** | (2006.01) |
| ***F23G 7/05*** | (2006.01) |
| *F23G 5/30* | (2006.01) |

(52) U.S. Cl.

CPC ..... *F22B 31/0023* (2013.01); *C10G 21/003* (2013.01); *C10G 75/04* (2013.01); *E21B 43/2406* (2013.01); *F22B 1/1884* (2013.01); *F22B 1/1892* (2013.01); *F22B 9/00* (2013.01); *F23C 10/12* (2013.01); *F23G 7/05* (2013.01); *F23G 5/30* (2013.01)

(58) Field of Classification Search

CPC ..... C10G 21/003; C10G 2300/1033; C10G 67/0454; E21B 43/2406; E21B 43/40

See application file for complete search history.

(56) References Cited

U.S. PATENT DOCUMENTS

| | | | | |
|---|---|---|---|---|
| 2008/0223754 | A1* | 9/2008 | Subramanian | C10G 67/0454 208/86 |
| 2009/0294328 | A1* | 12/2009 | Iqbal | C10G 21/003 208/67 |
| 2010/0155048 | A1* | 6/2010 | Hackett | E21B 43/164 166/52 |

* cited by examiner

*Primary Examiner* — Zakiya W Bates

(74) *Attorney, Agent, or Firm* — Boulware & Valoir

(57) ABSTRACT

A method for using untreated produced water to generate steam and simultaneously producing diluents is disclosed. The method includes a combustion process for generating steam for hydrocarbon recovery using untreated water and, an optional process for recovering combustion byproducts to assist in hydrocarbon recovery or solvent injections. Specifically, a novel combustion method and a double-tube heat exchanger are used to generate steam while minimizing or eliminating water treatment steps and boiler fouling. Low value pitch, also known as asphalt, is used for combustion fuel. In addition to the steam generation, byproducts of the combustion process can be utilized in solvent injections or as a diluent.

5 Claims, 2 Drawing Sheets

STEAM DILUENT GENERATOR

PRIOR RELATED APPLICATIONS

This invention claims priority to U.S. Provisional Nos. 62/079,281, filed Nov. 13, 2014, which is incorporated by reference in its entirety herein for all purposes.

FEDERALLY SPONSORED RESEARCH STATEMENT

Not applicable.

REFERENCE TO MICROFICHE APPENDIX

Not applicable.

FIELD OF THE DISCLOSURE

The disclosure generally relates to methods, devices, and systems for generating steam and/or diluent for downhole use in various steam assisted methods of producing hydrocarbons. More particularly, the specification illustrates a process for generating steam from produced water that simultaneously produces diluent.

BACKGROUND OF THE DISCLOSURE

Canada has some of the largest deposits of a heavy oil called bitumen. Unfortunately, the bitumen is especially difficult to recover because it is wrapped around sand and clay, forming what is call 'oil sands.' Bitumen is a thick, sticky form of crude oil, so heavy and viscous (thick) that it will not flow unless heated or diluted with lighter hydrocarbons. Indeed, the crude bitumen contained in the Canadian oil sands is described as existing in the semi-solid or solid phase in its natural deposits.

Conventional approaches to recovering heavy oils such as bitumen often focus on lowering the viscosity through the addition of heat. Commonly used in situ extraction thermal recovery techniques include a number of reservoir heating methods, such as wellbore heating, wellbore combustion, hot fluid injection, steam flooding, cyclic steam stimulation, Steam Assisted Gravity Drainage (SAGD), in situ combustion, and variations thereon.

SAGD is the most extensively used technique for in situ recovery of bitumen resources. In SAGD, steam is injected continuously into the injection well, where it rises in the reservoir and forms a steam chamber. The heat from the steam reduces the hydrocarbon's viscosity, thus enabling the heated crude and condensed steam to flow down to the production well and be transported to the surface via pumps or lift gas. The produced hydrocarbon thus is a mixture of hydrocarbon and water. SAGD is very water intensive, requiring 3-5 barrels of water to produce a barrel of oil. It is also very energy intensive, as considerable energy is needed to generate the steam.

One improvement to SAGD that has the potential to reduce water and energy usage is combining solvent injections with SAGD. For instance, expanding solvent SAGD (ES-SAGD) injects a low concentration hydrocarbon additive with the steam. The additive condenses with the steam at the boundary of the steam chamber causing oil dilution and further viscosity reduction. In solvent-cyclic-SAGD (SC-SAGD), the wells are started with steam and quickly progress to the addition of solvents. The initial solvent is often a heavy solvent, with lighter solvents being injected over time. The amount of steam injected declines as the solvent is injected.

Even though, the industry is moving toward injection of solvent in the reservoir to lower steam-to-oil ratios, the purchase/transportation of make-up solvent (beyond typically recovered solvent) can be expensive and every effort to reduce solvent usage or increase its recovery for re-use contributes to efficiency and cost effectiveness.

As mentioned, SAGD requires large amounts of water in order to generate a barrel of oil. Because water is as precious a resource as oil, the "produced water" is usually recycled. It is thus cleaned and returned to the boiler, where it is converted into steam and re-injected back into the ground.

Due to the recycling of water in SAGD operations, and the fact that the water encounters petroleum deposits as well as any additives used in production, the feedwater used to make steam is typically far from pure. Produced water and brackish well water are the main boiler feedwater sources and the contaminants in these two water sources differ. Water separated from the produced oil emulsion (produced water) is high in silica and in soluble organic compounds (see e.g., Table 1). Brackish well water, in contrast, can be high in hardness ions (calcium and magnesium) (see e.g., Table 2). The combination of these waters can be unstable and can produce a variety of mineral scales.

TABLE 1

Range of typical solute concentrations in produced feedwater

| Component | Minimum | Maximum |
|---|---|---|
| Ca (mg/l) | 1 | 52 |
| Mg (mg/l) | 1.6 | 14 |
| K (mg/l) | 14 | 240 |
| Na (mg/l) | 130 | 3000 |
| $SiO_2$ (mg/l) | 11 | 260 |
| TOC (mg/l) | 170 | 430 |
| $NH_3$ (mg/l) | 11 | 64 |
| Cl (mg/l) | 48 | 4800 |
| pH (s.u.) | 7.3 | 8.8 |
| "M" alkalinity (mg/l as $CaCO_3$) | 140 | 1400 |

TABLE 2

Range of typical solute concentrations in brackish wellwater

| Component | Minimum | Maximum |
|---|---|---|
| Ca (mg/l) | 2.0 | 45 |
| Mg (mg/l) | 1.5 | 32 |
| K (mg/l) | 2.2 | 250 |
| Na (mg/l) | 700 | 3700 |
| $SiO_2$ (mg/l) | 8 | 10 |
| TOC (mg/l) | nd | 5 |
| $NH_3$ (mg/l) | nm | nm |
| Cl (mg/l) | 480 | 5300 |
| "M" (mg/l as $CaCO_3$) | 880 | 1200 |

nd = not detected
nm = not measured

Traditional boilers typically cannot accommodate these impurities, and have a great tendency to foul, thus increasing down time and contributing to costs. Water treatment equipment for removing organic and inorganic constituents, however, only adds to the capital and operating costs in preparing water for traditional boilers. Therefore, any technology that can reduce water or steam consumption has the potential to have significant positive environmental and cost impacts.

Thus, further improvements to steam generation methods are desired to improve recovery and cost efficiency in SAGD, ES-SAGD and other steam based enhanced recovery methods. In particular, a method that reduces water usage, reduces fouling, and at the same time reduces solvent costs would be greatly beneficial.

SUMMARY OF THE DISCLOSURE

The disclosure describes a fluid bed combustor with a novel controlled heat flux concept and combustion method for a steam generation of minimally treated produced water. Byproducts of the combustion method can then be recycled to assist in hydrocarbon recovery or separation of solvents if solvent injections are used.

In the novel combustion method, heavy oil, typically from the bottoms of atmospheric or vacuum distillation columns, is separated into de-asphalted oil (DAO) and pitch (high C to H ratio) inside a Solvent De-asphalting unit (SDA). The hot pitch is then injected into the fluid bed combustor boiler at one or more locations to ensure a good distribution of suspended particles. Air is blown through the boiler and contacted with the hot pitch, thus providing the feed for the combustion process in the fluid bed combustor. The temperature of the bed (dense phase) is preferably near 1300° F. (704.44 C) during the combustion process to minimize the formation of NOx.

The media in the fluidized bed preferably includes a solid media that absorbs sulfur oxides (SOx) including sulfur oxide (SO), sulfur dioxide ($SO_2$), sulfur trioxide ($SO_3$), sulfur tetroxide ($SO_4$) and other sulfur oxides, nitric oxides (NOx) including nitric oxide (NO) and other nitrogen oxides, and metal emissions from the combustion process, thus decreasing emissions of dangerous chemicals.

The heat exchange for creating steam occurs in a novel double-tube arrangement (concentric tubes) where an outer fluid (e.g. 2500 psi clean steam) absorbs heat generated from the fluidized bed combustor operating at 1200-1400° F. (649-760° C.). As the high-pressure steam, at saturated conditions and with a high latent heat of evaporation, absorbs heat from the fluidized bed, it also transfers heat, via the finned inner tube, at a constant but lower heat flux to produced water, brackish water, or any water having contaminants, in the inner tube. By combining water in the inner tube with proper chemicals and low vaporization per pass, the fouling that normally is encountered with high heat flux boilers is minimized. Thus, this process minimizes or eliminates the need for installing and operating water treatment of the dirty water in preparation for the boiler.

In solvent injection methods, the separated DAO can also be combined with recovered solvent (including light end crudes) for re-injection or combined 'heavier-than-solvent' material to bitumen as diluent. This will result in higher quality crude and lower quantities of diluents being purchased. Thus, the method not only separates the recycle solvent but also combines solvent quality material generated from the de-asphalting process. However, for recovery techniques not utilizing solvent injections, the solvent splitter can be eliminated from the design. The solvent simply becomes part of the total diluent.

Expected advantages of this design include improved quality of crude; minimized or eliminated standard water treatment; reduction in diluent requirements for pipeline specifications; recovery and generation of make-up solvent for fields using combined steam/solvent injections; and, minimal fouling of steam generator.

Key concepts to novel combustion method of steam generation include:

A. Heat flux is controlled in a double tube exchanger. The boiler system can utilize a clean steam media in the outer tube at higher pressure with the produced water stream in the inner finned tube operating at lower pressure. The steam in the outer chamber serves to control the heat flux to the produced water, thus minimizing fouling. A variety of steam pressures may be utilized based on reservoir conditions.

B. A SDA takes heavy oil (typically bottoms from vacuum distillation in a refinery but capable of utilizing atmospheric bottoms as feed) and separates into De-asphalted Oil (DAO) and Pitch (high C to H ratio). Hot pitch is injected into the Boiler at several points for good distribution and is contacted by air where both feed the combustion process in the fluidized bed. The temperature of the bed (dense phase) should be about 1300° F. (1200-1400° F.). This is well below the approximately 2,500° F. where nitrogen oxides typically form.

C. The media (e.g. limestone) in the bed adsorbs SOx, NOx (trace amount), and metals.

D. The DAO from the SDA will be combined Pre-Frac Overheads (solvent recovery and bitumen light ends removal) for recovering the solvent for re-injection and combining 'heavier-than-solvent' material to bitumen as diluent.

Strengths of the novel combustion steam generation method:

1) Steam is generated using produced water, thus eliminating the majority of water treatments.

2) Flexibility in creating solvent when necessary or by not taking solvent draw from solvent splitter (or re-combining), the material will decrease the amount of trim diluent needed.

3) Eliminates (or minimizes) reliance on third parties for solvent.

4) Upgrades product quality by eliminating a portion of the high boiling point (low value) product.

5) Utilizes low value "pitch" or "asphalt" for combustion fuel used in steam generation reduces cost.

6) The SDA process is an established commercial process, facilitating implementation of the novel method and systems.

7) The boiler concept is based on solids fluidization technology, which is well understood and again facilitating implementation of the novel method and systems.

While the steam generation is described using produced water, any type of untreated water normally used in SAGD and other steam based enhanced recovery methods can be utilized.

The terms "pitch" and "asphalt" are used interchangeably to mean the thick, dark colored bituminous substances obtained as a result of industrial destructive distillation processes of petroleum.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| BFW | Boiler Feed Water |
| DAO | De-Asphalted Oil |
| ES-SAGD | Expanded Solvent Steam Assisted Gravity Drainage |
| FBC | Fluidized Bed Combustor |
| FG | Free Gas |
| FWKO | Free-Water KnockOut |
| HYSYS ® | Aspen HYSYS ® Process Modeling (HYSYS) |
| Pre-frac | Pre-Fractionator |
| RCRA | Resource Conservation and Recovery Act of 1976, as amended |
| SAGD | Steam Assisted Gravity Drainage |
| SC-SAGD | Solvent Cyclic Steam Assisted Gravity Drainage |
| SDA | Solvent De-Asphalting Unit |
| SOx | Sulfur Oxides |
| VRU | Vapor Recovery Unit |

DETAILED DESCRIPTION

Figure 1:
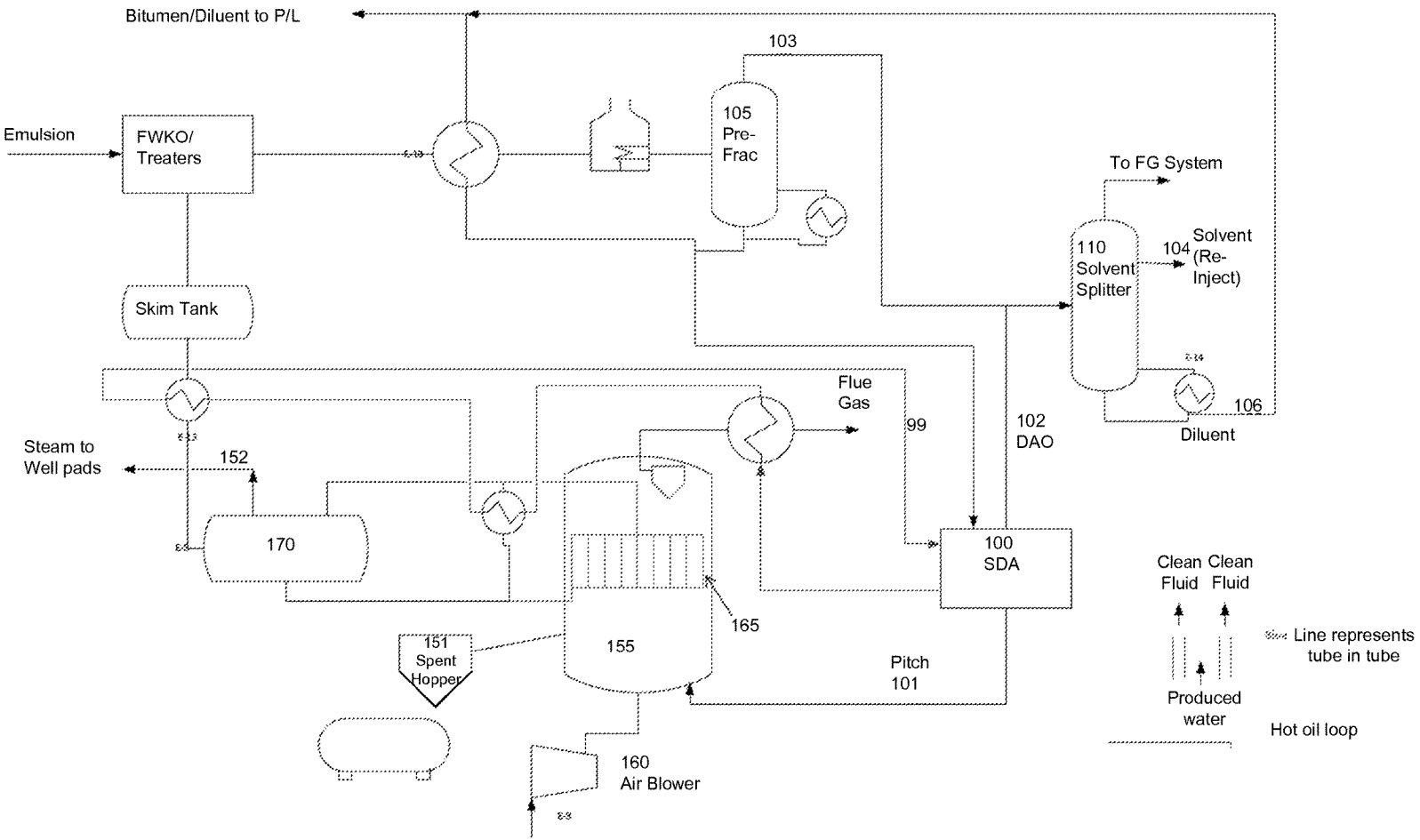
FIG. 1. displays a steam/solvent generator according to one embodiment.

The disclosure provides a novel combustion process for generating steam for hydrocarbon recovery using untreated water and, an optional process for recovering combustion byproducts to assist in hydrocarbon recovery or solvent injections. Specifically, a novel combustion method and a double-tube heat exchanger are used to generate steam while minimizing or eliminating water treatment steps and boiler fouling. Low value pitch, also known as asphalt, is used for combustion fuel. In addition to the steam generation, byproducts of the combustion process can be utilized in solvent injections or as a diluent.

In one embodiment, a steam generator for steam assisted oil recovery, utilizes: an SDA that generates hot pitch and DAO; an FBC boiler having at least one inlet for introducing said hot pitch and at least one inlet for introducing air, the hot pitch and air feed the combustion process, the fluid bed combustion boiler further comprising a solid media capable of capturing metals and oxide byproducts of said combustion process; and a double tube heat exchanger passing through said fluid bed combustion boiler, wherein a clean steam under pressure flows through the outer tube and oilfield produced water flows through inner tube of said heat exchanger.

In another embodiment, an apparatus for generating steam, solvent, and diluents for steam assisted oil recovery, is provided where an SDA generates hot pitch and DAO; an FBC boiler for hot pitch and air, where the hot pitch and air feed the combustion process, while the FBC boiler has a media capable of capturing metals and oxide byproducts of said combustion process; and a double tube heat exchanger passing through said fluid bed combustion, wherein a clean steam under pressure flows through the outer tube and an untreated water flows through inner tube of said heat exchanger;

The apparatus for generating steam and diluents for steam assisted oil recovery, may contain a SDA for generating hot pitch and SDA; a FBC boiler having at least one inlet for introducing said hot pitch and at least one inlet for introducing air, wherein the hot pitch and air feed the combustion process, the FBC boiler further comprising a media capable of capturing metals and oxide byproducts of said combustion process; and a double tube heat exchanger passing through the FBC, where a clean steam under pressure flows through the outer tube and an untreated water flows through inner tube of said heat exchanger; and a vessel for combining the DAO with produced heavy oil.

Additionally, a method of generating steam, solvent, and diluent for heavy oil recovery, is provided separating heavy oil into hot pitch and DAO in an SDA by introducing said hot pitch into a FBC boiler at one or more locations while simultaneous combining said DAO with low boiling compounds from said fractionator; contacting said hot pitch with air to provide feed for combustion and raise the operating temperature of the fluid bed combustion boiler to 1200 to 1400 F; introducing clean water into an outer tube of a double tube heat exchanger and a produced water into an outer tube of said double tube heat exchanger, where the clean water is converted to clean steam by combustion and the produced water is converted to steam by the clean steam; combining the clean steam and the steam for injection into a hydrocarbon-containing reservoir.

A method of generating steam using untreated produced water with reduced fouling, the method comprising: recovering production fluid from a reservoir; separating the production fluid into a heavy oil stream and an untreated produced water stream; separating heavy oil into hot pitch and de-asphalted oils (DAO) in a solvent de-asphalting unit (SDA); using hot pitch and air as fuel for combustion in a fluid bed combustion boiler; contacting the outer tube of a double tube heat exchanger with heat generated from said combustion, wherein said outer tube contains a clean steam under pressure; using heat from said outer tube transfer a constant but lower heat flux to an inner tube of said double tube heat exchanger, wherein said inner tube contains untreated produced water to generate a steam with minimal fouling of said inner tube.

The steam generator may have a solvent splitter for separating DAO into a makeup solvent stream and a diluent stream. The steam generator may also have a fractionator and vessel for mixing said DAO with low boiling compounds from said fractionator. Additionally, the steam generator may have a vessel for combining said makeup solvent stream with a solvent for injection into a hydrocarbon-containing reservoir. The steam generator may also have a vessel for combining said diluent stream with produced heavy oil.

Separating DAO and low boiling compounds with a solvent splitter into a makeup solvent stream and a diluent stream; injecting the makeup solvent stream into a hydrocarbon-containing reservoir; combining the diluent stream with produce heavy oil to reduce viscosity.

Combining DAO and low boiling compounds with a produced heavy oil to reduce viscosity.

During heat exchange, a de-fouling chemical may be added when heating the inner tube.

Oil sands SAGD operations require steam to be generated on site and injected. However, there are high requirements the for re-use of produced water from the reservoir. Produced water is often not suitable for conventional steam boiler technology, the contaminants contributing to fouling of traditional boiler equipment. Water treatment equipment for removing organic and inorganic constituents adds to the capital and operating costs in preparing water for traditional boilers. Also, diluents must be transported and blended with the produced oil at the site to meet viscosity specifications of the pipeline. Finally, the industry is moving towards the injection of solvent in the reservoir to lower steam to oil ratios and the purchase/transportation of make-up solvent (beyond typically recovered solvent) can be expensive. The presently described methods and systems address one or more of these concerns.

FIG. 1 displays a schematic of the steam solvent generator according to one embodiment of the present invention. This process is used when solvent methods are being utilized to recovery heavy oil. The SDA (100) separates hot heavy oil (99) into hot pitch and de-asphalted oil (DAO). The heavy oil typically is recovered from the bottoms of vacuum vats in a refinery.

The hot pitch (101) is injected into a fluid bed combustor boiler (155). While FIG. 1 shows the injection at one location, the hot pitch (101) can be injected at several locations to ensure a good distribution of suspended particles. Air (160) is blown through the boiler (155) to contact the hot pitch (101), thus providing the feed for the combustion process in the fluid bed combustor. The temperature of the bed (dense phase) is preferably about 1300° F. (704° C.) during the combustion process.

Ideally, the media in the fluid bed absorbs the SOx, NOx (trace), and metal emissions from the combustion process, thus decreasing emissions of dangerous chemicals. For instance, calcium and sodium based alkaline reagents can be used as an additive in the fluidization media to control SOx emissions. Metals easily adhere to most substrates selected for the fluidization media. It is expected that metal adsorption and SOx capture will exceed 95%. The operating temperature of the combustion boiler is well below that where NOx forms, but media is also expected to capture these chemicals as well.

The remaining byproducts of the pitch will be removed from the combustor boiler and collected in a spent hopper (151). The media does pass RCRA landfill requirements and may be useful in road underlayment or concrete. It also may be used for well pad builds or our road maintenance as there are frequently a large number of rural roads between facilities and well pads The heat produced in the combustion process contacts a double tube heat exchanger (165). The outer tubes contain clean steam media at approximately 2000 psig and the inner tubes contain produced water at approximately 1230 psig. This double tube design is used to control the heat flux to the produced water in the inner tubes. The high-pressure steam in the outer tubes absorbs the generated heat from the combustion process and transfers it at a constant but lower heat flux to the untreated water in the inner tubes. This lower heat flux will minimize fouling that is normally experienced when untreated water is used. The addition of de-fouling chemicals can also be used to further decrease the fouling.

The resulting steam produced in the inner tubes can be combined in the Steam/BFW Knock-out drum (170) before being injected into the reservoir (152).

The waste heat from the fluid bed combustion boiler can be captured by the cooled hot oil returning from the SDA strippers as part of the overall hot oil circulation loop.

The DAO (102) is combined with the overhead stream (103) coming from the prefractionator (105), which typically includes solvent and light hydrocarbons. The combined stream is introduced into solvent splitter (110) to generate a supplemental solvent stream (104) for re-injection into the reservoir or a diluent stream (106) to be mixed with the heavy oil (e.g. bitumen) to meet pipeline specifications. For instance, if solvent is used in the operation, e.g. C5 hydrocarbons, the solvent can be recovered in the pre-frac (105) and any C5 hydrocarbons in the SDA (100) can be separated and added to the solvent before being injection into the reservoir. This will result in higher quality crude and lower quantities of diluents being purchased.

Figure 2:
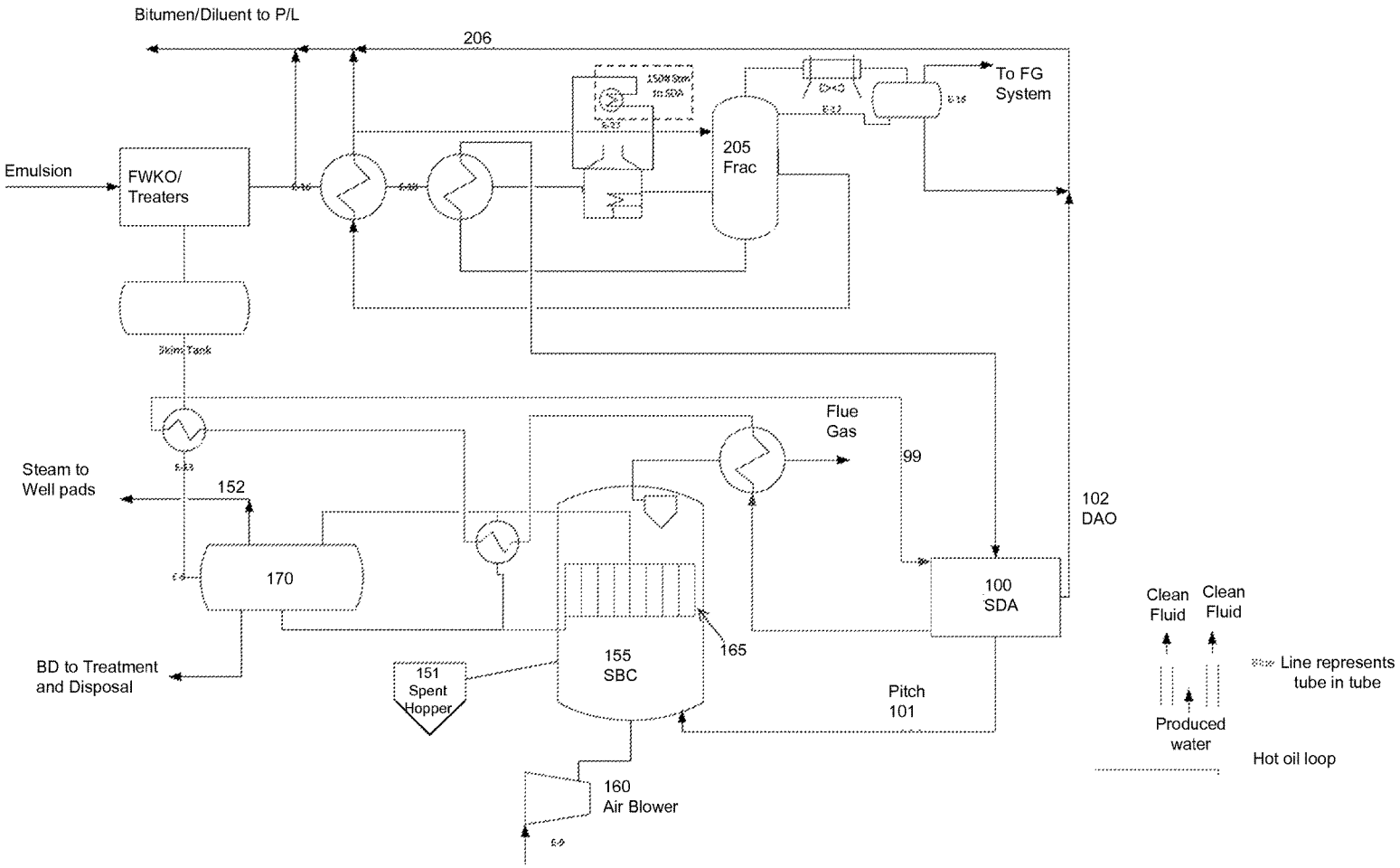
FIG. 2. displays a steam/diluent generator according to another embodiment for no solvent injections.

If solvent is not recovered, a much simpler process flow, as displayed in FIG. 2, can be utilized with any solvent from the SDA (100) being used as the diluent. In this process, the DAO (102) is combined with light hydrocarbons fractionated from the produced oil in a fractionator (105) to form a diluent stream (206).

Example 1: Process

HYSYS® Process modeling has been used to develop the heat and material balances for multiple configurations.

In the case where solvent injection into the reservoir does not occur, the incoming emulsion is separated in traditional knock-out drums or treaters. The oil leaving the separation process at the pipeline specifications for water content in oil will split with only the portion needed to meet the pitch feed rate as determined by the duty requirements of the fluidized bed combustor (FBC), proceeds through the pre-heat sections and furnace prior to entering the fractionator. The fractionator bottoms and 'pump-around' (PA) streams are returned for pre-heat in the previous exchangers. Stripping steam is utilized in the fractionator to reduce the partial pressure and thus maximize lift. A portion of the 150# steam generated from the waste heat of the flue gas from the furnace is used as stripping steam and the remainder of the steam will be utilized as low level heat for the SDA process. A portion of the PA will be product to the diluent and be a rough cut of heavy naptha through light gas oil range material. The overheads will be separated with gas to the vapor recovery unit (VRU) and the liquids (unstabilized light naphtha) will be directed to the diluent stream. The bottoms of the fractionation unit will be directed to the Solvent Deasphalting Unit (SDA) upon cooling by the incoming feed. The SDA is capable of taking the Atmospheric Resid and separating the more valuable paraffins from the often heavier naphthenic materials which have a higher carbon to hydrogen ratio. Solvents can be any C3's, C4's, or C5's or can even be a mixture of various hydrocarbons in the desired boiling range. As the molecular weight increases, the yield of DAO increases but there is a trade-off in desired DAO yields and the costs due to circulations rates and recovery. This must be optimized on a case-by-case basis. A typical problem of the use for pitch fits well in this scheme as the pitch is immediately fed to the FBC where it is combined with air in a bed of media where combustion occurs. Air flow will exceed stoichiometric requirements to ensure complete combustion (minimize CO) and due to the nature of the fluidized bed, will make for a uniform bed temperature. This feature makes is simple to control the heat flux to the high pressure steam which serves as a barrier fluid. When combined, this makes hot spots to the low pressure steam on the inner tube. A constant heat flux, chemical treating, and maintaining low vaporization rates of the low pressure steam eliminates fouling despite minimal water treatment.

The water from the oil/water separators is pumped to an intermediate pressure and pre-heated by hot oil to a temperature just below the bubble point. The circulating BFW from the Steam/BFW drum and fresh BFW is combined and circulated through the FBC exchanger. After 20%-40% vaporization (depending on water quality), the two-phase system returns to the Steam/BFW drum where steam separates and heads to the respected well-head while the remaining BFW will be recirculated or taken to blow-down treatment and disposal (aka purge stream).

There are two circulating loops for heat transfer. The first is the high pressure steam which can work on a thermo-syphon principle or can be used in a forced circulation mode. The water enters the outside of the tube as mentioned previously where it is serving to transfer heat from the FBC media to the low pressure steam in the FBC and is then condensed via the tube side of the Steam/BFW knock-out drum (where the condensation of the high pressure steam vaporizes the low pressure BFW). A second circulation loop is the hot oil (or 150# steam)

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

What is claimed is:

1. A steam generator for steam assisted oil recovery, comprising:

a) a solvent de-asphalting unit (SDA) for generating hot pitch and de-asphalted oils (DAO), said SDA having an outlet for removing said hot pitch and an outlet for removing said DAO;

b) a fluid bed combustion boiler having at least one inlet for introducing said hot pitch and at least one inlet for introducing air, wherein said hot pitch and said air feed the combustion process, said fluid bed combustion boiler further comprising a solid media capable of capturing metals and oxide byproducts of said combustion process; and c) a double tube heat exchanger passing through said fluid bed combustion boiler, wherein a clean steam under pressure flows through the outer tube and oilfield produced water flows through inner tube of said heat exchanger.

2. The steam generator in claim 1, further comprising a fractionator and vessel for mixing said DAO with low boiling compounds from said fractionator.

3. The steam generator in claim 2, wherein said mixtures is separated into a makeup solvent stream and a diluent by a solvent splitter.

4. A method of generating steam using untreated produced water with reduced fouling, the method comprising:

a) recovering production fluid from a reservoir;

b) separating the production fluid into a heavy oil stream and an untreated produced water stream;

c) separating said heavy oil stream into hot pitch and de-asphalted oils (DAO) in a solvent de-asphalting unit (SDA);

d) using said hot pitch and air as fuel for combustion in a fluid bed combustion boiler;

e) contacting an outer tube of a double tube heat exchanger with heat generated from said combustion in said fluid bed combustion boiler, wherein said outer tube contains a clean steam under pressure;

f) using heat from said outer tube transfer a constant but lower heat flux to an inner tube of said double tube heat exchanger, wherein said inner tube contains untreated produced water to generate a steam with minimal fouling of said inner tube.

5. The method of claim 4, further comprising adding a de-fouling chemical to said inner tube.

* * * * *